US011376757B2

(12) United States Patent
Gravel

(10) Patent No.: US 11,376,757 B2
(45) Date of Patent: Jul. 5, 2022

(54) LUMBER LOADING SYSTEM AND METHOD FOR SIMULTANEOUS LOADING AND LONGITUDINAL DISPLACEMENT OF SUCCESSIVE LUMBER PIECES USING SAME

(71) Applicant: VAB MACHINES INC., Lévis (CA)

(72) Inventor: Claude Gravel, St-Férréol les Neiges (CA)

(73) Assignee: Smart Mill BD Inc., Quebec (CA)

( * ) Notice: Subject to any disclaimer, the term of this patent is extended or adjusted under 35 U.S.C. 154(b) by 311 days.

(21) Appl. No.: 16/492,379

(22) PCT Filed: Mar. 9, 2018

(86) PCT No.: PCT/CA2018/050286

§ 371 (c)(1),
(2) Date: Sep. 9, 2019

(87) PCT Pub. No.: WO2018/161174

PCT Pub. Date: Sep. 13, 2018

(65) Prior Publication Data

US 2020/0039105 A1 Feb. 6, 2020

Related U.S. Application Data

(60) Provisional application No. 62/469,882, filed on Mar. 10, 2017.

(51) Int. Cl.
*B27B 31/00* (2006.01)
*B26D 7/01* (2006.01)

(52) U.S. Cl.
CPC ..... *B27B 31/00* (2013.01); *B26D 7/01* (2013.01)

(58) Field of Classification Search
CPC ..... B27B 31/00; B26D 7/01; B65G 43/08; B65G 47/261; B65G 2201/282
(Continued)

(56) References Cited

U.S. PATENT DOCUMENTS 3,812,951 A * 5/1974 Fullaway ..... B65G 47/295 198/458
4,515,196 A 5/1985 Shields
(Continued)

FOREIGN PATENT DOCUMENTS

WO WO 01/38849 A1 5/2001

OTHER PUBLICATIONS

Extended European Search Report, dated Dec. 10, 2020, in connection with European Appln. No. 18763189.0.
(Continued)

*Primary Examiner* — Omar Flores Sanchez
(74) *Attorney, Agent, or Firm* — Fay Sharpe LLP

(57) ABSTRACT

A lumber loading system for transferring lumber pieces. The lumber loading system comprises a driving shaft rotating about a longitudinal axis; at least one lumber piece grasping assembly operatively connected to the driving shaft and rotating about the longitudinal axis; and a longitudinal positioning system connected to the at least one lumber piece grasping assembly. The at least one lumber piece grasping assembly is displaceable along the longitudinal axis and is operative to initially grasp a section of a corresponding lumber piece extending longitudinally substantially parallel to the longitudinal axis, temporarily maintain the section of the lumber piece and subsequently release the lumber piece. The longitudinal positioning system moves each one of the at least one lumber piece grasping assembly independently along the longitudinal axis, during rotation thereof about the longitudinal axis. A method for
(Continued)

simultaneous loading and longitudinal displacement of successive lumber pieces is also provided.

20 Claims, 7 Drawing Sheets

(58) Field of Classification Search
USPC ..... 83/732
See application file for complete search history.

(56) References Cited

U.S. PATENT DOCUMENTS

| | | | | |
|---|---|---|---|---|
| 5,518,106 | A | 5/1996 | Allard | |
| 5,662,203 | A | 9/1997 | St-Pierre et al. | |
| 6,220,423 | B1 | 4/2001 | Gagnon et al. | |
| 9,926,144 | B1 * | 3/2018 | Lepage | B65G 43/08 |
| 10,416,146 | B2 * | 9/2019 | Gravel | G01N 33/46 |
| 2010/0252397 | A1 * | 10/2010 | Beaudet | B27B 31/00 198/341.04 |
| 2014/0209433 | A1 * | 7/2014 | Wight | B65G 47/682 198/456 |
| 2015/0353296 | A1 | 12/2015 | Petryshen et al. | |
| 2018/0086568 | A1 * | 3/2018 | Lepage | B27B 31/08 |
| 2019/0375127 | A1 * | 12/2019 | Mitchell | B27B 1/007 |
| 2020/0246999 | A1 * | 8/2020 | Jin | B23D 59/001 |
| 2021/0261353 | A1 * | 8/2021 | Gravel | B65G 47/252 |

OTHER PUBLICATIONS

International Search Report and Written Opinion, dated Jun. 7, 2018, in connection with PCT/CA2018/050286, filed Mar. 9, 2018.

* cited by examiner

LUMBER LOADING SYSTEM AND METHOD FOR SIMULTANEOUS LOADING AND LONGITUDINAL DISPLACEMENT OF SUCCESSIVE LUMBER PIECES USING SAME

CROSS-REFERENCE TO RELATED APPLICATIONS

This application claims priority to and the benefit of the filing date of International Application No. PCT/CA2018/050286, filed Mar. 9, 2018, which application claims priority under 35USC § 119(e) of US provisional patent application 62/469,882, which was filed on Mar. 10, 2017, the specifications of which are hereby incorporated by reference.

TECHNICAL FIELD OF THE INVENTION

The present invention relates to the field of lumber loading and trimming. More particularly it relates to a lumber loading system for transferring lumbers between a first carrier assembly and a second carrier assembly while positioning the lumber longitudinally and to a method of operation of the system for performing the same.

BACKGROUND

In the field of lumber production, loading systems are commonly used to individually transfer lumber pieces between a first carrier assembly and a second carrier assembly. Typically, upon loading of the lumber pieces on the second carrier assembly by such a loading system, each one of the lumber pieces are loaded between cleats (or lugs, or cleat sets) of the second carrier assembly and can be subsequently processed individually in the production line.

For example and without being limitative, loading systems are generally used to transfer the lumber pieces on a carrier assembly (or conveyor), following the planing of the lumber pieces, to subsequently perform trimming and/or sorting thereof. Typically, in order to perform the trimming and/or sorting, each lumber piece is individually marked and is subsequently loaded by the loading system onto the carrier assembly. Once it is loaded on the carrier assembly, each lumber piece corresponding to a specific cleat (or lug, or cleat set) is identified (for example by reading the previously generated mark or tracking); the trimming position is determined according to optimization parameters based on characteristics of the lumber piece (e.g. curvature data, modulus of elasticity data, etc.); the lumber piece is moved longitudinally on the carrier assembly (i.e. the lumber piece is moved along its length as it is conveyed transversally to its length on the carrier assembly) to be positioned properly for trimming; the trimming is performed as the lumber piece is moved by the carrier assembly along the production line; and the lumber piece is subsequently sorted for subsequent operations.

It will be understood that, each operation of the above described sequence of operations for performing trimming and/or sorting requires space along the carrier assembly, thereby resulting in substantial longitudinal space being required for the system performing these operations as the lumber pieces are conveyed. For example, see FIG. 1 showing a prior art system for performing trimming and sorting of lumber pieces. Moreover, some operations which are intrinsically linked (such as the longitudinal positioning of the lumber pieces and the trimming thereof) are performed sequentially, thereby resulting in increased production time and a possible loss of precision due to the transfer of the lumber pieces between the performance of the operations.

In view of the above, there is a need for an improved loading system and method of operation thereof, which would be able to overcome or at least minimize some of the above-discussed prior art concerns.

BRIEF SUMMARY OF THE INVENTION

According to a first general aspect, there is provided a lumber loading system for transferring lumber pieces conveyed in a conveying direction defined by a conveying axis. The lumber loading system comprises a driving shaft rotating about a longitudinal axis; at least one lumber piece grasping assembly operatively connected to the driving shaft and rotating about the longitudinal axis along with the driving shaft; and a longitudinal positioning system connected to the at least one lumber piece grasping assembly. The at least one lumber piece grasping assembly is displaceable along the longitudinal axis and is operative to initially grasp a section of a corresponding one of the lumber pieces with the corresponding one of the lumber pieces extending longitudinally substantially parallel to the longitudinal axis, temporarily maintain the section of the lumber piece and subsequently release the lumber piece. The longitudinal positioning system moves each one of the at least one lumber piece grasping assembly independently along the longitudinal axis, during rotation thereof about the longitudinal axis.

In an embodiment, the lumber loading system further comprises guiding shafts rotating along with the rotation of the driving shaft and extending along the longitudinal axis. The guiding shafts support each one of the at least one lumber piece grasping assembly slidably mounted thereon. Each one of the at least one lumber piece grasping assembly is movable longitudinally along corresponding ones of the guiding shafts.

In an embodiment, the at least one lumber piece grasping assembly each include a carriage slidably engaged with the corresponding ones of the guiding shafts. The carriage comprises at least one lumber supporting member engaging a first surface of a corresponding lumber piece and at least one lumber grasping member selectively engageable to a second surface of the lumber piece, opposed to the first surface thereof.

In an embodiment, the longitudinal positioning system comprises a linear actuator connected to the carriage of each one of the at least one lumber piece grasping assembly and selectively driving the corresponding carriage along the longitudinal axis.

In an embodiment, the lumber loading system comprises a plurality of lumber piece grasping assemblies angularly spaced apart around the driving shaft.

In an embodiment, the longitudinal axis is substantially perpendicular to the conveying axis.

In an embodiment, the lumber loading system further comprises a trimming assembly configured and positioned to trim at least one end of the lumber pieces transferred by the lumber loading system. The trimming assembly comprises at least one trimmer having a trimming blade operatively connected to a motor driving the trimming blade in rotation.

In an embodiment, the trimming assembly includes a first trimming assembly and a second trimming assembly. The first trimming assembly is positioned to trim a first end of the lumber pieces transferred by the lumber loading system at a first angular position about the longitudinal axis and the second trimming assembly is positioned to trim a second end of the lumber pieces transferred by the lumber loading system at a second angular position about the longitudinal axis, angularly distal from the first angular position.

In an embodiment, the longitudinal positioning system is configured to position each one of the at least one lumber piece grasping assembly in a first longitudinal position along the longitudinal axis, prior to a corresponding one of the lumber pieces maintained thereby reaching the angular position of the first trimming assembly, and to position each one of the at least one lumber piece grasping assembly in a second longitudinal position along the longitudinal axis, prior to the corresponding one of the lumber pieces maintained thereby reaching the angular position of the second trimming assembly.

In an embodiment, the lumber loading system further comprises at least one supplemental supporting assembly operative to grasp, temporarily maintain and subsequently release a supplemental section of the lumber pieces along the longitudinal axis, during a least a portion of the transfer of the lumber pieces.

In an embodiment, each one of the at least one supplemental supporting assembly comprises at least one support wheel mounted to the driving shaft and having a supplemental lumber engaging surface engageable to a first surface of the lumber pieces and at least one supplemental lumber grasping member selectively engageable to a second surface of the lumber pieces, opposed to the first surface thereof.

In accordance with another general aspect, there is also provided a method for simultaneous loading and longitudinal displacement of successive lumber pieces. For each one of the successive lumber pieces, the method comprising the steps of: conveying the lumber piece in a conveying direction defined by a conveying axis; grasping the lumber piece using a lumber piece grasping assembly with the lumber piece extending longitudinally substantially parallel to a longitudinal axis substantially perpendicular to the conveying axis; maintaining the lumber piece using the lumber piece grasping assembly during rotation of the lumber piece grasping assembly about the longitudinal axis and simultaneously displacing the lumber piece grasping assembly longitudinally along the longitudinal axis, to position the lumber piece at a predetermined longitudinal position thereof; and releasing the lumber piece from the lumber piece grasping assembly.

In an embodiment, the method further comprises the step of determining an optimized longitudinal position of the lumber piece and wherein the predetermined longitudinal position is the optimized longitudinal position.

In an embodiment, the step of grasping the lumber piece using a lumber piece grasping assembly includes pivoting at least one pivoting finger in an engaged configuration to engage a surface of the lumber piece and press a portion of the lumber piece against a lumber supporting surface of the lumber supporting member of the lumber piece grasping assembly.

In an embodiment, the method further comprises the step of trimming at least one end of the lumber piece. The step of trimming at least one end of the lumber piece is performed after the step of displacing the lumber piece grasping assembly longitudinally and before the step of releasing the lumber piece from the lumber piece grasping assembly.

In an embodiment, the method further comprises the steps of initially trimming a first end of the lumber piece and subsequently trimming a second end of the lumber piece. The steps of trimming a first end of the lumber piece and trimming a second end of the lumber piece are performed at different angular positions of the lumber piece grasping assembly about the longitudinal axis.

In an embodiment, the steps of displacing the lumber piece grasping assembly longitudinally along the longitudinal axis comprises performing a first longitudinal displacement of the lumber piece grasping assembly prior to the step of trimming a first end of the lumber piece and performing a second longitudinal displacement of the lumber piece grasping assembly following the step of trimming the first end of the lumber piece and prior to the step of trimming the second end of the lumber piece.

In an embodiment, the method further comprising the steps of: grasping at least one additional section of the lumber piece being transferred, using at least one supplemental supporting assembly; temporarily maintaining the at least one additional section of the lumber piece using the at least one supplemental supporting assembly; and releasing the lumber piece from the at least one supplemental supporting assembly.

In an embodiment, the method further comprises the steps of: grasping a first additional section of the lumber piece being transferred, using a first subset of the at least one supplemental supporting assembly, following the step of performing the first longitudinal displacement of the lumber piece grasping assembly and prior to the step of trimming the first end of the lumber piece; releasing the lumber piece from the first subset of the at least one supplemental supporting assembly following the step of trimming the first end of the lumber piece and prior to the step of performing the second longitudinal displacement of the lumber piece grasping assembly; grasping a second additional section of the lumber piece being transferred, using a second subset of the at least one supplemental supporting assembly, following the step of performing the second longitudinal displacement of the lumber piece grasping assembly and prior to the step of trimming the second end of the lumber piece; and releasing the lumber piece from the at least one supplemental supporting assembly following the step of trimming the second end of the lumber piece.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

Figure 1:
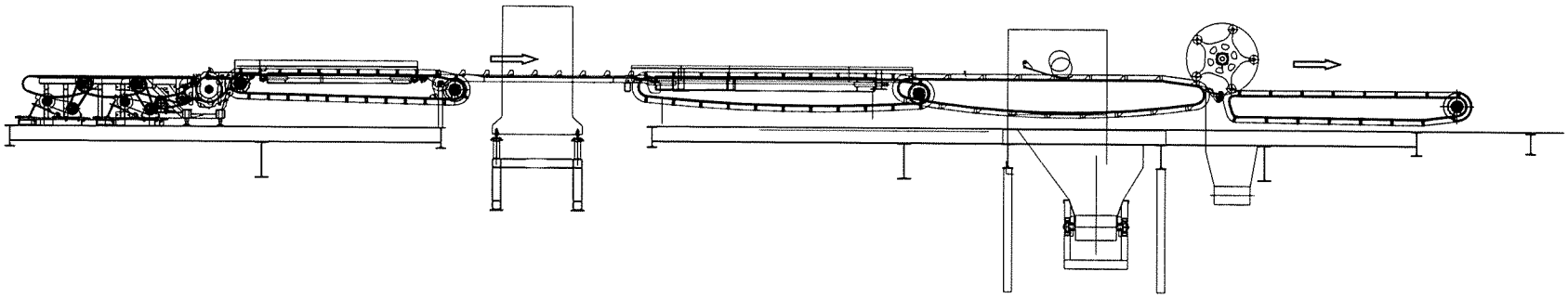
FIG. 1 (PRIOR ART)
FIG. 1 is a side schematic representation of a prior art system for performing trimming of lumber pieces, in accordance with an embodiment.
Figure 2:
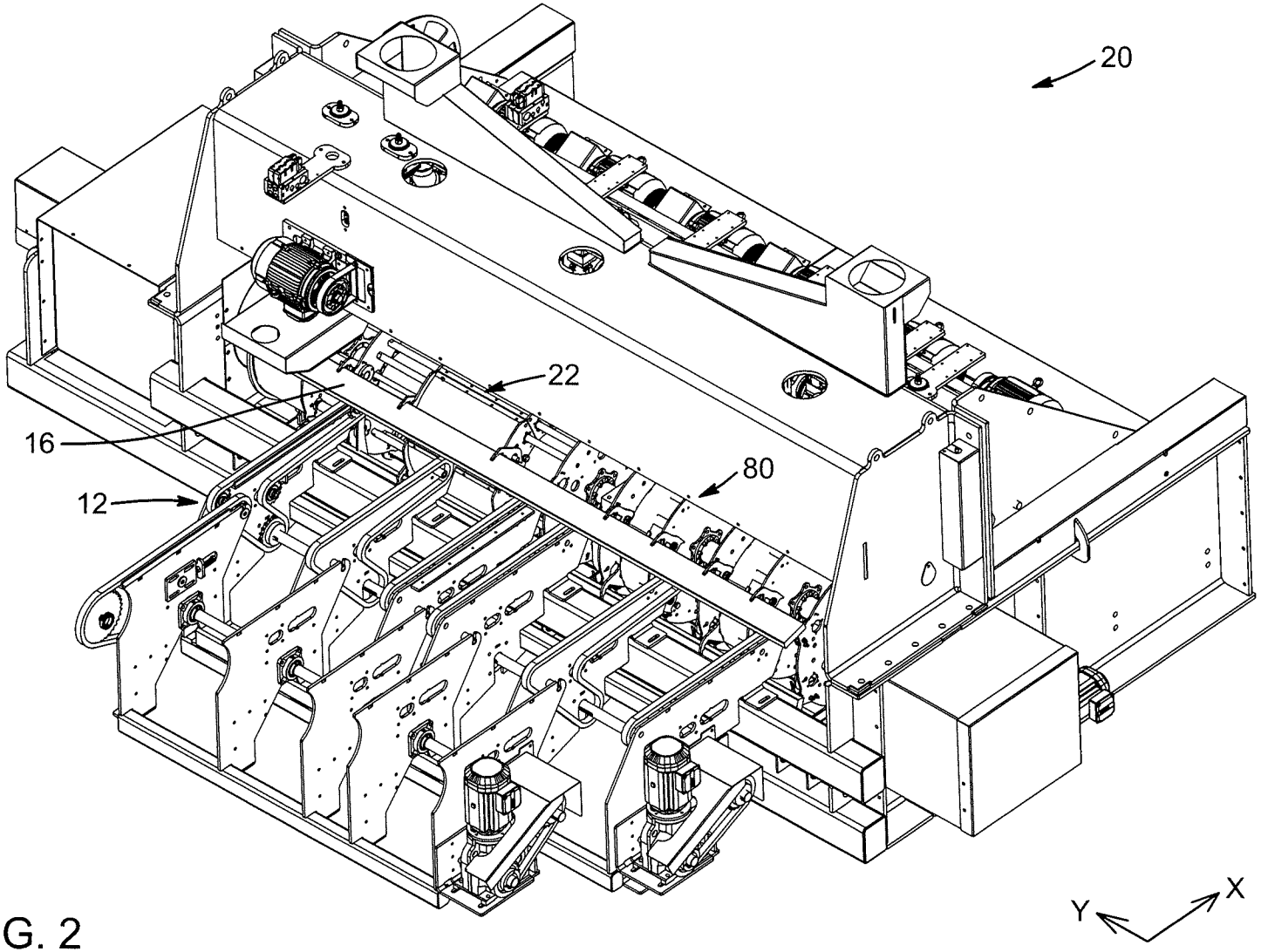
FIG. 2 is an isometric view of a lumber loading system, in accordance with an embodiment.
Figure 3:
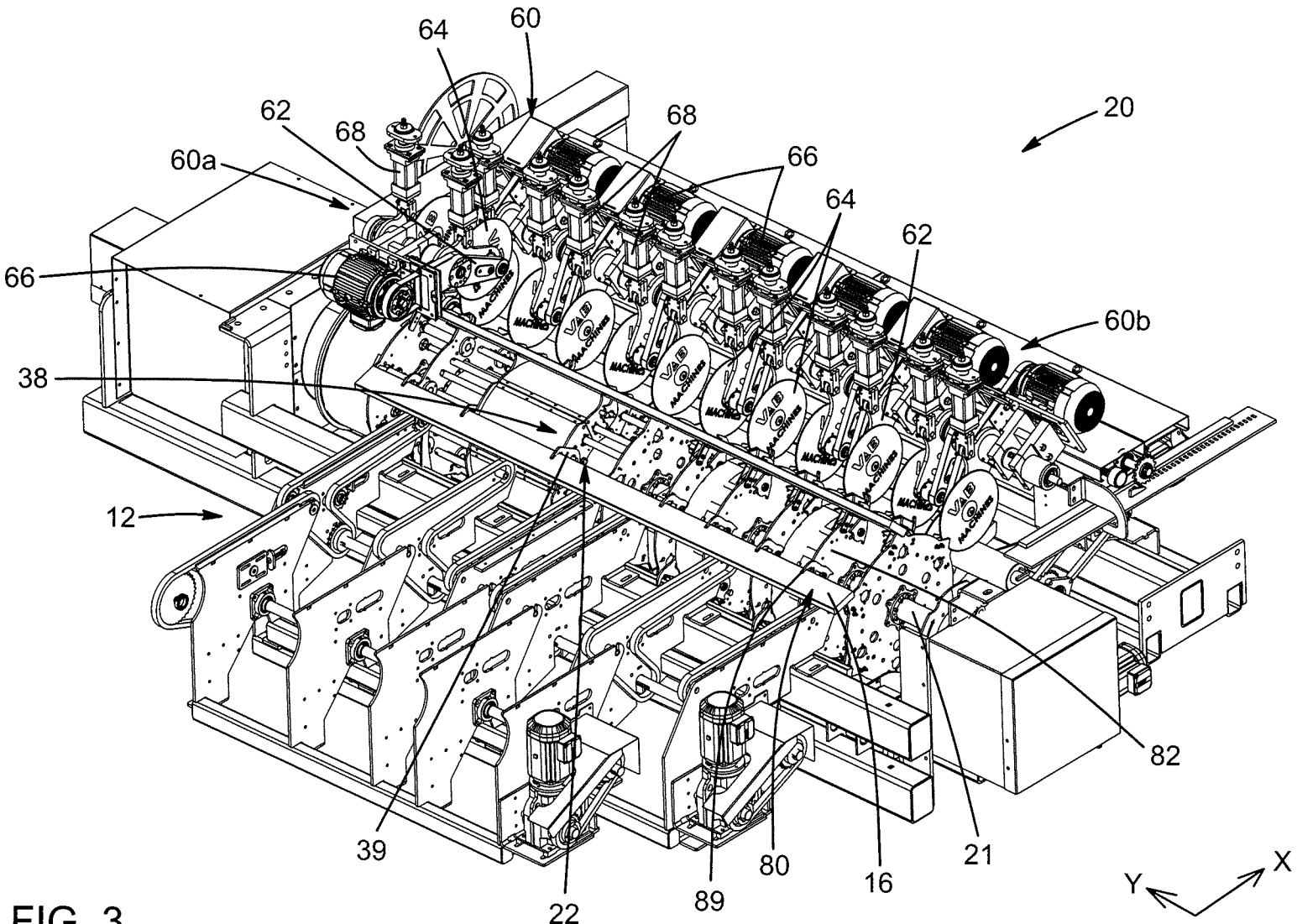
FIG. 3 is an isometric view of the lumber loading system of FIG. 2, shown with a top cover removed to allow a better viewing of the components thereof.
Figure 4:
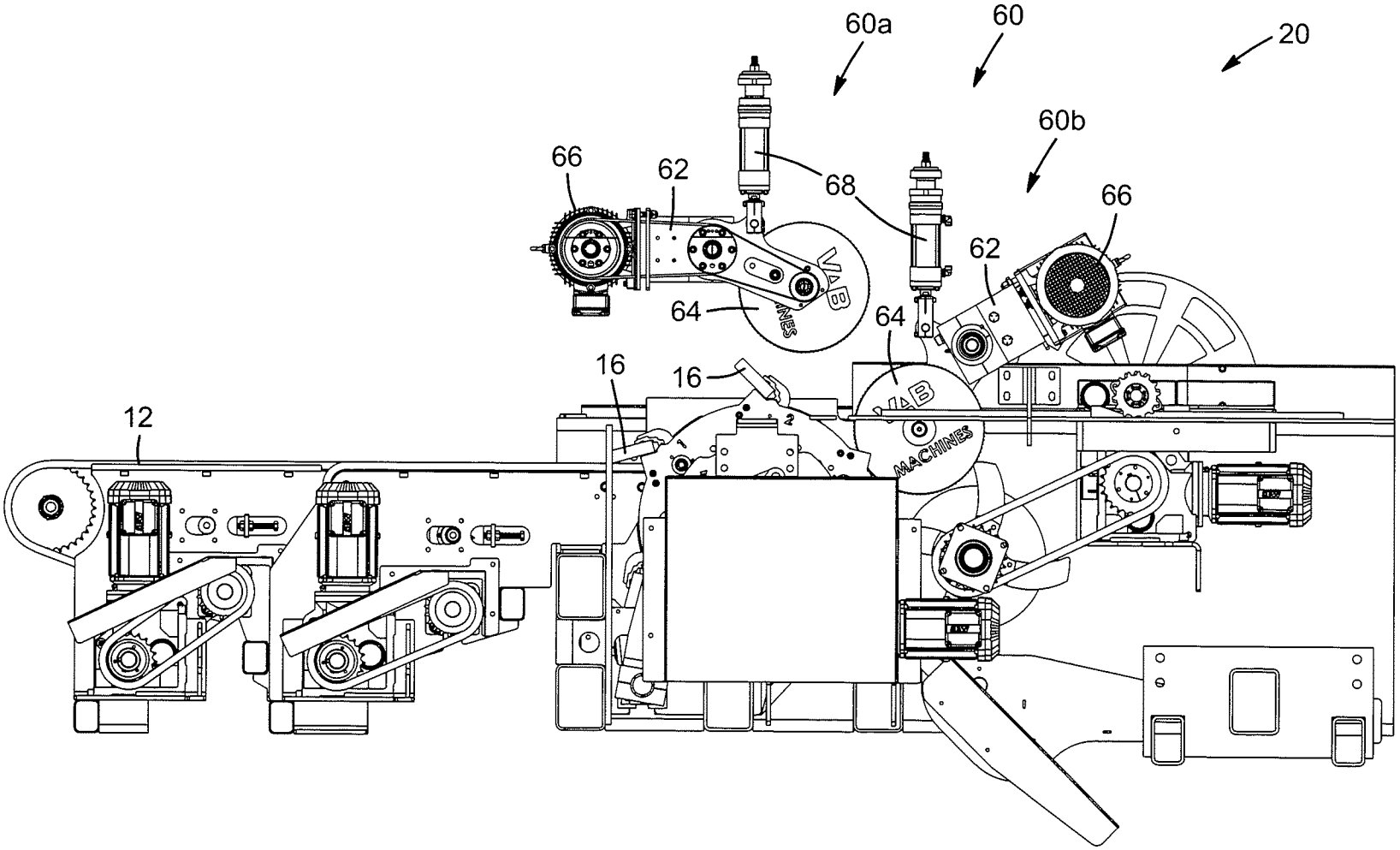
FIG. 4 is a side elevation view of the lumber loading system of FIG. 3.

In the following description, the same numerical references refer to similar elements. The embodiments, geometrical configurations, materials mentioned and/or dimensions shown in the figures or described in the present description are embodiments only, given solely for exemplification purposes.

Although the embodiments of the lumber loading system and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the lumber loading system, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Moreover, although the embodiments as illustrated in the accompanying drawings comprise particular steps of a method, not all of these steps are essential and thus should not be taken in their restrictive sense. It is to be understood, as also apparent to a person skilled in the art, that other suitable sequence of operations may be used for the method, as will be briefly explained herein and as can be easily inferred herefrom, by a person skilled in the art, without departing from the scope of the invention.

Referring generally to FIGS. 2 to 7, in accordance with one embodiment, there is provided a lumber loading system 20. The lumber loading system 20 is configured to cooperate with a first carrier assembly 12 positioned upstream of the lumber loading system 20 along a production line (not shown) and operative to convey successive lumber pieces 16 towards the lumber loading system 20 and at least a second carrier assembly (not shown) positioned downstream of the lumber loading system 20 along the production line and operative to receive the lumber pieces 16 from the lumber loading system 20 and subsequently convey the lumber pieces 16 away from the lumber loading system 20. The lumber pieces 16 are elongated workpieces conveyed in a conveying direction (i.e. conveyed in a direction defined by a lumber conveying axis X). For example and without being limitative, the lumber pieces 16 can be elongated planed lumber, such as wood planks or the like. Hence, one skilled in the art will understand that the lumber loading system 20 can be part of a production line which extends along the lumber conveying axis X thereof, substantially perpendicular to the length of the lumber pieces 16 and where the lumber pieces 16 are transversally conveyed along the lumber conveying axis X of the production line. In other words, the lumber pieces 16 are conveyed along the lumber conveying axis X of the production line (and extend longitudinally substantially transversally to the lumber conveying axis X), as they are conveyed along the first carrier assembly 12, the lumber loading system 20, and the second carrier assembly (not shown).

The lumber loading system 20 is configured to transfer the lumber pieces 16 from the first carrier assembly 12 to the second carrier assembly (not shown) and perform longitudinal movement (i.e. longitudinal positioning) of each one of the lumber pieces 16, as they are being transferred (i.e. simultaneously with the transfer movement thereof). In order to perform the longitudinal displacement of the lumber pieces 16 during the transfer thereof, the lumber loading system 20 includes a driving shaft 21 rotatable about a longitudinal axis Y and at least one longitudinally movable lumber piece grasping assembly 22 (i.e. at least one lumber piece grasping assembly 22 movable along the longitudinal axis Y) operatively connected to the driving shaft 21. The lumber piece grasping assembly 22 is operative to grasp a section of a transferred lumber piece 16, with the lumber piece 16 extending longitudinally substantially parallel to the longitudinal axis Y, temporarily retain the section of the transferred lumber piece 16 as the lumber piece grasping assembly 22 is rotated about the longitudinal axis Y and moved longitudinally along the longitudinal axis Y, and subsequently release the transferred lumber piece 16.

In the embodiment shown, a plurality of angularly spaced-apart lumber piece grasping assemblies 22 are operatively connected to the driving shaft 21, each lumber piece grasping assembly 22 transferring a corresponding lumber piece 16. Hence, in operation, each lumber piece grasping assembly 22, grasps, maintains, longitudinally positions and releases a corresponding lumber piece 16, such that multiple lumber pieces 16 can be simultaneously transferred and longitudinally positioned by the lumber loading system 20. Each lumber piece grasping assembly 22 is independent, such that each lumber piece 16 temporarily maintained by a corresponding lumber piece grasping assembly 22 can be independently moved longitudinally to reach a desired longitudinal position thereof, as it is being transferred.

In the embodiment shown, each lumber piece grasping assembly 22 includes a carriage 30 slidably mounted relative to the driving shaft 21 (and relative to the longitudinal axis Y). More particularly, in the embodiment shown, the lumber loading system 20 includes guiding shafts 24 rotatable along with the rotation of the driving shaft 21 and extending along the longitudinal axis Y, with the carriage 30 being slidably mounted to the guiding shafts 24, to be freely movable therealong. Hence, each carriage 30 is slidable with regard to the corresponding guiding shafts 24, in order to the positioned according to the longitudinal axis Y, as will be described in more details below.

One skilled in the art will understand that, in alternative embodiments (not shown), other assemblies could be provided to allow the movement of the carriage 30 of each lumber piece grasping assembly, along the longitudinal axis Y. For example and without being limitative, in an embodiment (not shown) the lumber loading system 20 could include a supporting base mounted to the driving shaft 21 and rotating therewith, with the supporting base including guiding shafts extending along the longitudinal axis Y, for each corresponding carriage 30 operatively connected to the driving shaft 21 and each carriage 30 including sliders slidably engaged with the corresponding guiding shafts.

To grasp, temporarily retain and subsequently release the lumber pieces 16, the carriage 30 of each lumber piece grasping assembly 22 further includes at least one lumber supporting member 34 engaging a first surface of a corresponding lumber piece 16 and at least one lumber grasping member 38 selectively engageable to a second surface of the lumber piece 16, opposed to the first surface thereof.

In the embodiment shown in FIGS. 2 to 7, each carriage 30 has two lumber supporting members 34 spaced apart along the longitudinal axis Y. Each lumber supporting member 34 has a lumber supporting surface 35 defined at an outer edge thereof, with a projecting tooth 36 extending substantially radially therefrom and engaging the first surface of the lumber piece 16. The carriage 30 further includes a lumber grasping member 38, embodied by two pivoting fingers 39 pivotable between an engaged configuration and a disengaged configuration. The pivoting fingers 39 are each positioned proximate to a corresponding lumber supporting member 34.

In the engaged configuration, each pivoting finger 39 is pivoted to engage the second surface of the lumber piece 16, thereby sandwiching a portion of the lumber piece 16 between a section of the lumber supporting surface 35 of the lumber supporting member 34 and the corresponding pivoting finger 39 (i.e. pressing the portion of the lumber piece 16 against the section of the lumber supporting surface 35) and firmly maintaining the lumber piece 16 therebetween. In an embodiment, in the engaged configuration, each pivoting finger 39 presses the portion of the lumber piece 16 against at least portion of the projecting tooth 36 of the lumber supporting surface 35 of the lumber supporting member 34.

In the disengaged configuration, each pivoting finger 39 is pivoted away from the second surface of the lumber piece 16 (i.e. away from the lumber supporting surface 35 of the corresponding lumber supporting member 34) and is disengaged therefrom. Therefore, when the pivoting fingers 39 are pivoted from the engaged configuration to the disengaged configuration, the grip is released on the lumber piece 16. In an embodiment, the pivoting fingers 39 are each connected to a rotary actuator 40 pivoting the corresponding pivoting finger 39 between the engaged configuration and the disengaged configuration and vice-versa. In the embodiment shown, the rotary actuators 40 are pneumatic actuators. One skilled in the art will however understand that, in alternative embodiments (not shown), the rotary actuators 40 could be of another type such as, for example an electric actuator or the like.

One skilled in the art will understand that, in alternative embodiments, the lumber piece grasping assembly 22 operative to firmly maintain the lumber piece 16 being transferred, could differ from the embodiment shown. For example and without being limitative, more or less than the two spaced apart lumber supporting members 34 could be provided and/or the lumber supporting members 34 could be free of projecting tooth 36. Moreover, more or less than the two pivoting fingers 39 could be provided and/or a component different from a pivoting finger could be used for the lumber grasping member 38. Furthermore, an assembly different from the above described guiding shafts and sliders could be provided to allow movement of the carriages 30 relative to the driving shaft 21, along the longitudinal axis Y. For example and without being limitative, a longitudinally displaceable clamp or other types of longitudinally displaceable engaging member could be used.

Figure 5:
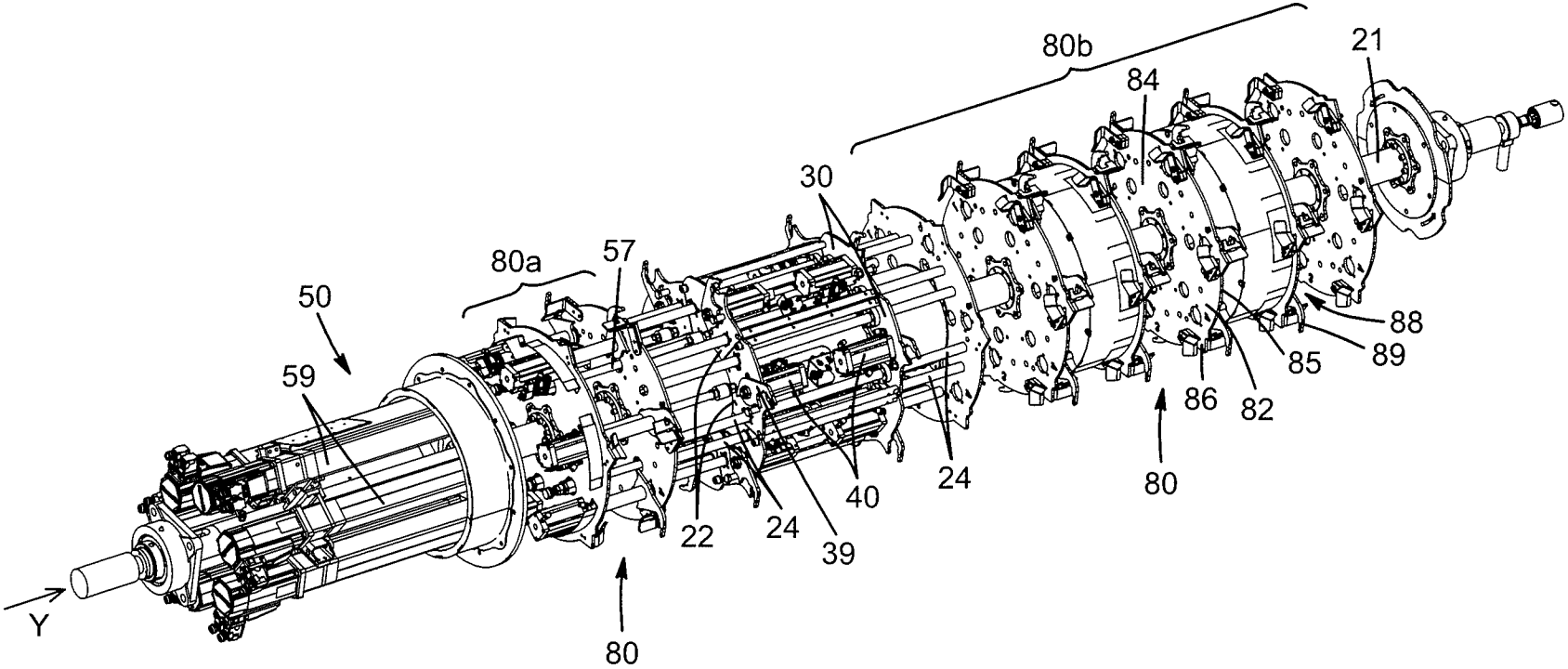
FIG. 5 is an isometric view of the rotating shaft of the lumber loading system of FIG. 2, with the components of the lumber loading system mounted thereto, and shown in isolation.
Figure 6:
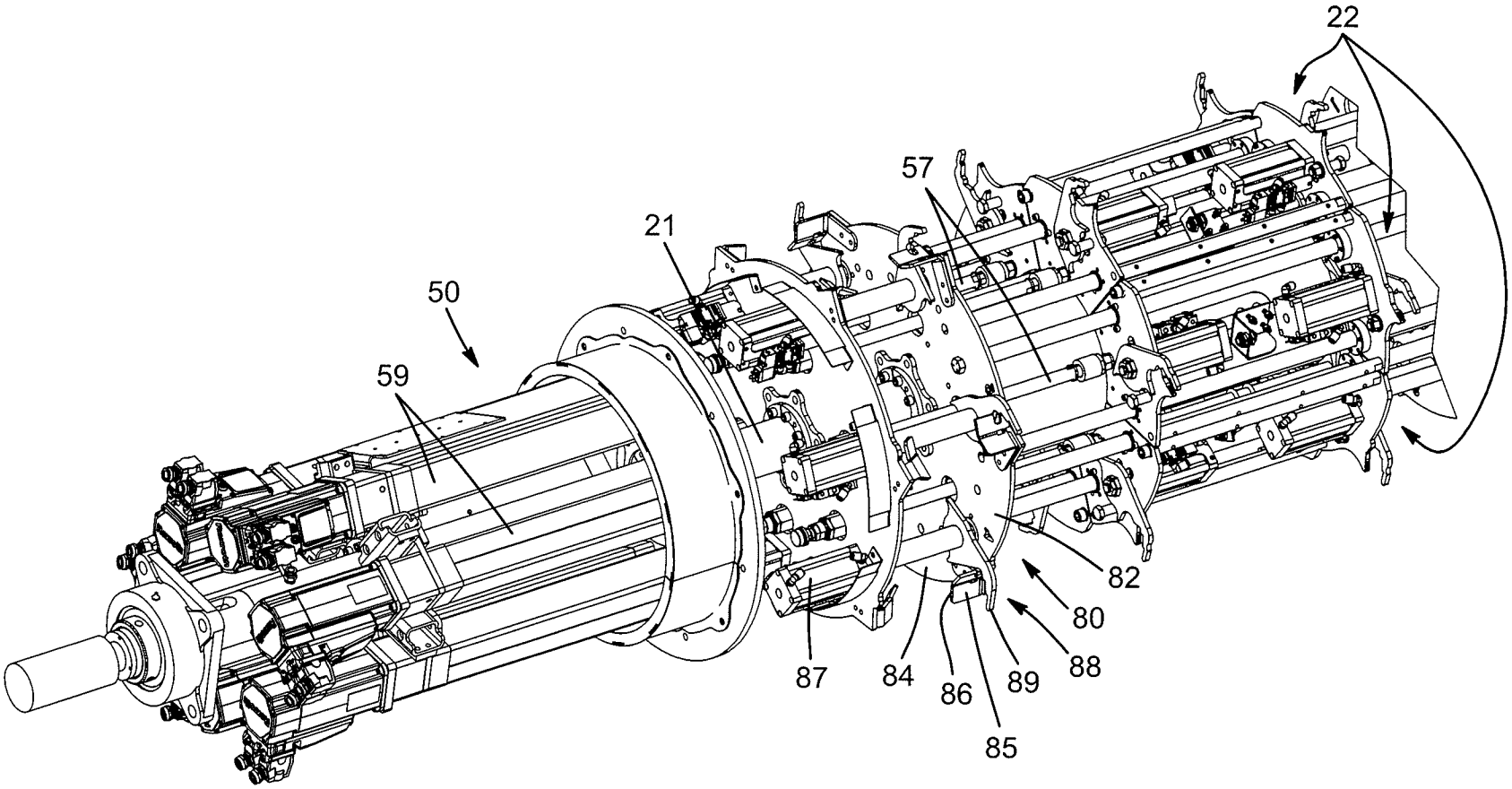
FIG. 6 is an enlarged view of a section the rotating shaft of the lumber loading system of FIG. 5 with the components of the lumber loading system mounted thereto, shown in isolation, showing in more details a longitudinal positioning assembly.
Figure 7:
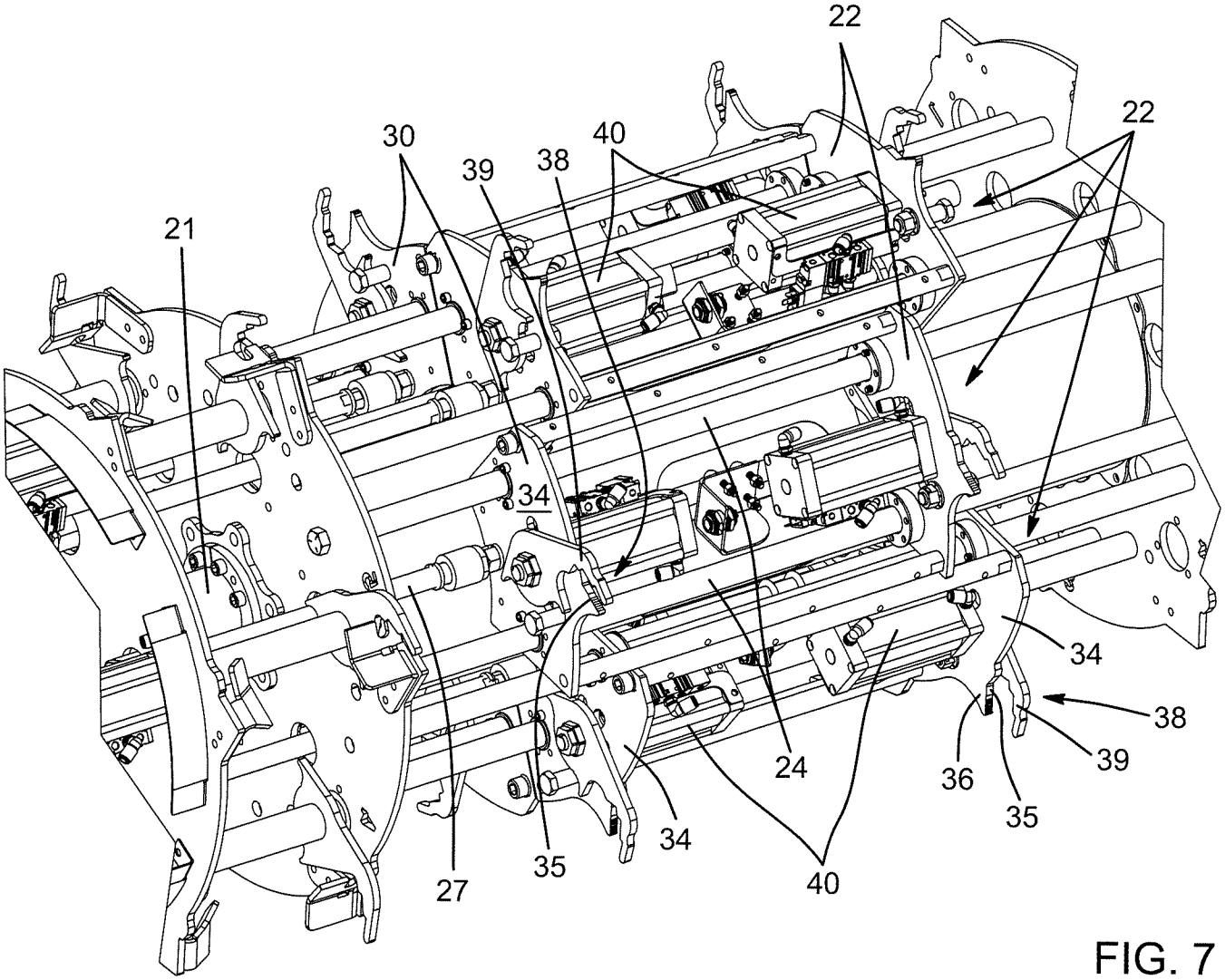
FIG. 7 is an enlarged view of another section of the rotating shaft of the lumber loading system of FIG. 5 with the components of the lumber loading system mounted thereto, shown in isolation, showing in more details the lumber piece grasping assemblies.

Referring to more particularly to FIGS. 5 and 7, to move the lumber piece 16 longitudinally (i.e. along the longitudinal axis Y) as it is being transferred by the lumber loading system 20, the lumber loading system 20 further includes a longitudinal positioning assembly 50 moving each lumber piece grasping assembly 22 longitudinally along the longitudinal axis Y. For example and without being limitative, in FIG. 7, one of the carriage 30 of a lumber piece grasping assembly 22 is shown in a longitudinal position different from the longitudinal position of the other carriages 30. As can be seen in FIG. 7, the carriage 30 moves relative to the guiding shafts 24 as it is being displaced longitudinally.

In the embodiment shown, the longitudinal positioning assembly 50 includes a linear actuator 59 connected to each carriage 30 by a connecting shaft 57 and linearly displacing the corresponding carriage 30 along the longitudinal axis Y. For example and without being limitative, in an embodiment, each linear actuator 59 includes a servomotor which allows a precise control of the linear position of the corresponding carriage 30. One skilled in the art will understand that, several types of linear actuators (or motors) could be used as part of the servomotor, such as, without being limitative, a mechanical actuator, a hydraulic actuator, a pneumatic actuator, a piezoelectric actuator, or the like. The linear actuator 59 performs longitudinal positioning of each carriage 30 during rotation of the driving shaft 21, thereby resulting in longitudinal movement of the corresponding lumber piece 16 grasped by the corresponding lumber piece grasping assembly 22, during its transfer.

One skilled in the art will again understand that, in alternative embodiments (not shown), a longitudinal positioning assembly 50 different than the embodiment shown could be used for performing the longitudinal displacement of the lumber piece grasping assemblies 22.

For example and without being limitative, in an alternative embodiment (not shown), the longitudinal positioning assembly 50 could include a positioning cam and a positioning cam follower mounted to each carriage 30 of a lumber piece grasping assembly 22 and engageable with a corresponding positioning cam and a return cam and a return cam follower mounted to each carriage 30 and engageable to the corresponding return cam for returning the carriage to an initial carriage position, following the longitudinal positioning thereof. In such an embodiment, during operation, the positioning cam could be actuated to drive the cam follower and displace the carriage 30 along the longitudinal axis Y. Following the longitudinal positioning of the carriage 30 by the combination of the positioning cam driving the positioning cam follower, the carriage 30 could be driven back to an initial longitudinal position through engagement of the return cam follower with the return cam. An actuator could be provided to move the positioning cams in order to induce movement to the corresponding carriages 30, through the positioning cam follower, and position the carriages 30 in the desired longitudinal positions.

In the embodiment shown, the longitudinal positioning assembly 50 can move the lumber piece grasping assemblies 22 in a first direction along the longitudinal axis Y and a second direction opposed to the first direction also along the longitudinal axis Y. For example and without being limitative, in an embodiment, the longitudinal positioning assembly 50 can move the lumber piece grasping assemblies 22 of at least about 6 inches in the first direction and at least about 6 inches in the second direction, thereby providing a longitudinal travel distance of at least about 12 inches.

In an embodiment, the lumber loading system 20 carries each transferred lumber pieces 16 between a grasping position and a release position along at least about 90° and less than about 270° and, in a particular embodiment, less than about 180°.

In the embodiment shown, the lumber loading system further includes at least one supplemental supporting assembly 80 for engaging and supporting the corresponding lumber pieces 16, along supplemental sections thereof, during the transfer of the lumber pieces 16. In the embodiment shown, the supplemental supporting assembly 80 includes at least one support wheel 82 mounted to the driving shaft 21 and operating as supplemental lumber supporting members 84. The support wheel 82 has a supplemental lumber engaging surface 85 and supplemental projecting teeth 86 extending substantially radially therefrom and substantially angularly aligned with the projecting teeth 36 of the lumber piece grasping assemblies 22. The supplemental supporting assembly 80 also includes supplemental lumber grasping members 88, embodied by supplemental pivoting fingers 89 pivotable between an engaged configuration and a disengaged configuration (similar to the above described engaged configuration and a disengaged configuration of the pivoting fingers 39 of the lumber grasping member 38 of the lumber piece grasping assembly 22). The supplemental pivoting fingers 89 are each connected to a rotary actuator 87 pivoting the corresponding supplemental pivoting finger 89 between the engaged configuration and the disengaged configuration and vice-versa. In the embodiment shown, the rotary actuators 87 are pneumatic actuators. One skilled in the art will however understand that, in alternative embodiments (not shown), the rotary actuators 87 could be of another type such as, for example an electric actuator or the like.

As can be seen in the Figures, the lumber grasping members 88 are substantially angularly aligned with the lumber grasping members 38 of the lumber piece grasping assemblies 22, to clasp the corresponding section of one of the lumber piece between the corresponding supplemental pivoting finger 89 (or angularly aligned set of pivoting fingers 89) and at least a section of the corresponding one of the supplemental teeth 86.

In the embodiment shown, the at least one support wheel 82 of each one of the at least one supplemental supporting assembly 80 is fixedly mounted to the driving shaft 21 (i.e. is not displaceable along the longitudinal axis Y) and has sections (i.e. a corresponding supplemental tooth 86 and lumber grasping members 88) angularly aligned with each corresponding lumber piece grasping assembly 22. Hence, the supplemental grasping members 88 thereof are operative to grasp and retain the corresponding sections of the lumber piece 16 engaged by each supplemental supporting assembly 80, once the lumber piece 16 has been properly positioned longitudinally by the corresponding lumber piece grasping assembly 22. In other words, the at least one supplemental supporting assembly 80 can grasp the corresponding section of the lumber piece 16 at a later time than the corresponding lumber piece grasping assembly 22, once the lumber piece grasping assembly 22 has been positioned longitudinally, such that the lumber piece 16 has reached the desired longitudinal position.

As will be described in more details below, in an embodiment, the supplemental supporting assembly 80 allow a section of a corresponding lumber piece 16 to be maintained, for example during and/or following the trimming thereof (i.e. until the lumber piece 16 is released by the corresponding lumber piece grasping assembly 22). This allows a better trimming as the lumber piece is maintained in a section proximal to where the lumber piece is trimmed and prevents a trimmed section (a section release from the lumber piece following the trimming) to fall and thereby potentially interfere with the proper functioning of the apparatus.

In an embodiment, the at least one supplemental supporting assembly 80 could include a first subset 80*a* of supplemental supporting assemblies 80 and a second subset 80*b* of supplemental supporting assemblies 80, with the first subset of supplemental supporting assemblies 80*a* and the second subset of supplemental supporting assemblies 80*b* engaging separate sections of a lumber piece 16. In an embodiment, the supplemental lumber grasping members 88 of the first subset of supplemental supporting assemblies 80*a* and the second subset of supplemental supporting assemblies 80*b* could engage the lumber piece 16 at different angular position around the longitudinal axis, for example in order to match the trimming performed at the corresponding angular position.

One skilled in the art will understand that, in alternative embodiments (not shown), the at least one supplemental supporting assembly 80 could include lumber supporting members 84 spaced apart along the longitudinal axis Y with independent freely movable sections (i.e. independent portions including a supplemental lumber engaging surface 85 and a supplemental lumber grasping member 88, for example embodied by at least one supplemental pivoting finger 89 pivotable between an engaged configuration and a disengaged configuration) substantially angularly aligned with a corresponding carriage 30 around the driving shaft 21, rather than the support wheel 82 of the embodiment shown. In an embodiment (not shown), each one of the independent sections can be operatively connected to the driving shaft 21, to be freely longitudinally movable therealong. Hence, in such embodiments, the supplemental lumber grasping member 88 can be operative to grasp and retain the section of the lumber piece substantially simultaneously to the corresponding lumber piece grasping assembly 22, such that the independent freely movable sections of the supplemental supporting assembly 80 are independently moved along with the corresponding lumber piece 16 being moved longitudinally, as a result of the corresponding lumber piece grasping assembly 22 being driven longitudinally by the longitudinal positioning assembly 50. In other words, in such embodiments, the independent freely movable sections of the supplemental supporting assembly 80 are not actuated but rather simply movable with regard to the longitudinal axis Y, along with the corresponding lumber piece 16 it temporarily grasps.

In an embodiment, the lumber loading system 20 includes an electronic control system (not shown) operatively connected to the actuators 40 of the lumber grasping member 38 and/or the linear actuators 59 of the longitudinal positioning assembly 50 and/or the actuators 87 of the supplemental grasping members 88 of the supplemental supporting assembly, such that the operations of the components of the lumber piece grasping assembly 22, the longitudinal positioning assembly 50 and/or the supplemental supporting assembly 80, for grasping, maintaining, longitudinally moving and releasing the transferred lumber piece 16, are synchronized. Hence, each transferred lumber piece 16 is moved longitudinally as sections of the transferred lumber piece 16 are being maintained and supported by the lumber supporting member 34 and the lumber grasping member 38. In an embodiment, the electronic control system can receive data relative to each lumber piece 16 in order to perform the specific longitudinal displacement for each one of the lumber piece 16 being transferred as will be described in more details below.

For example and without being limitative, in an embodiment, a scanning assembly can scan the lumber pieces 16 conveyed on the first carrier assembly 12 to examine the lumber pieces 16 and generate optimization parameters thereof related to the longitudinal positioning of each lumber pieces 16, with the electronic control system controlling the components of the lumber piece grasping assembly 22, the longitudinal positioning assembly 50 and/or the supplemental supporting assembly 80 according to the received optimization parameters.

Referring to FIGS. 2 to 7, in the embodiment shown, the lumber loading system 20 further includes a trimming assembly 60 operative to perform trimming of at least one end of the lumber pieces 16 transferred and longitudinally positioned by the lumber loading system 20. The trimming assembly 60 includes at least one trimmer 62 having a trimming blade 64 operatively connected to a motor 66 driving the trimming blade 64 in rotation. In such an operation, each lumber piece 16 being transferred by the lumber loading system 20 can consequently be adequately positioned longitudinally (through longitudinal movement of the corresponding lumber piece grasping assembly 22) for the trimming blade 64 to engage the lumber piece 16 at the desired position and therefore trim the lumber piece 16 according to optimization parameters specific to the lumber piece 16.

In an embodiment, the trimming assembly 60 can include a plurality of trimmers 62 spaced apart along the longitudinal axis Y and/or a plurality of trimming blades 64 spaced apart along the longitudinal axis Y and operatively connected to the motor 66 of a trimmer 62 for driving the trimming blades 64 in rotation. Hence, the trimming assembly 60 can include multiple trimmers 62 or multiple trimming blades 64 positioned along the longitudinal axis Y and engageable to a section of the lumber pieces 16 for performing trimming thereof. Therefore, in such an embodiment a smaller longitudinal displacement of the lumber piece 16 by the longitudinal positioning assembly 50 can be required to position the lumber piece 16 adequately, relative to a trimming blade 64, to perform the trimming thereof. In other words, in such an embodiment, the lumber piece 16 is only required to be positioned longitudinally relative to the trimming blade 64 closest to the section of the lumber piece 16 that is to be trimmed.

For example and without being limitative, in an embodiment, where the longitudinal positioning assembly 50 can move the lumber piece grasping assemblies 22 of about 6 inches in the first direction and about 6 inches in the second direction, thereby providing a longitudinal travel distance of about 12 inches, the multiple trimmers 62 or multiple trimming blades 64 positioned along the longitudinal axis Y can be spaced apart of a distance of about 12 inches along the longitudinal axis Y. One skilled in the art will understand that, in alternative embodiments where the longitudinal positioning assembly 50 can move the lumber piece grasping assemblies 22 of a different distance, the distance between the multiple trimmers 62 or multiple trimming blades 64 along the longitudinal axis Y can be adjusted to substantially match the longitudinal travel distance provided by the longitudinal positioning assembly 50.

In an embodiment, each one of the multiple trimmers 62 or multiple trimming blades 64 positioned along the longitudinal axis Y can be selectively and independently movable transversally to the longitudinal axis Y (for example in a substantially downward/upward movement), such that the trimmer 62 or trimming blade 64 closest to the section of the lumber piece 16 that is to be trimmed can be moved toward the lumber piece 16 to perform the trimming. For example and without being limitative, each one of the multiple trimmers 62 or multiple trimming blades 64 can be connected to a linear trimmer actuator 68 activable to selectively move the corresponding trimmer 62 or trimming blade 64 in the substantially downward/upward movement to proceed to the trimming of the lumber piece 16. In an embodiment, the linear trimmer actuator 68 can be a pneumatic actuator. One skilled in the art will understand that, in alternative embodiments, the linear trimmer actuator 68 can be of another type, such as, a mechanical actuator, a hydraulic actuator, a piezoelectric actuator, or the like.

In the embodiment shown, the lumber loading system 20 includes a first trimming assembly 60*a* and a second trimming assembly 60*b*, each trimming the lumber pieces 16 at a different angular position, as the lumber pieces 16 are being transferred. In the embodiment shown, the first trimming assembly 60*a* includes a single trimmer 62 and is positioned upstream of the second trimming assembly 60*b*, along the lumber conveying axis X. The second trimming assembly 60*b* includes multiple trimmers 62 substantially angularly aligned along the longitudinal axis Y. The combination of the first trimming assembly 60*a* and the second trimming assembly 60*b* allows each lumber piece 16 transferred by the lumber loading system 20 to be trimmed twice, with the lumber piece 16 being moved longitudinally between the first trimming assembly 60*a* and the second trimming assembly 60*b*.

In view of the above, it will be understood that the lumber piece grasping assemblies 22 of the lumber loading system 20 can each be independently moved longitudinally by the longitudinal positioning assembly 50 prior to reaching the angular position where the first trimming assembly 60*a* engages the piece of lumber 16 and be again moved longitudinally by the longitudinal positioning assembly 50 after moving past the angular position where the first trimming assembly 60*a* engages the piece of lumber 16 and before reaching the angular position where the second trimming assembly 60*b* engages the piece of lumber 16. Such a combination allows production of lumber pieces 16 of many different lengths, without being limited to the distance between two of the multiple trimmers 62 or trimming blades 64 of a single trimming assembly.

In an embodiment the electronic control system (not shown) can also be operatively connected to the trimming assembly 60 (i.e. operatively connected to the trimmers 62, the motor 66 associated to a trimmer blade 64 and/or the trimmer actuator(s) 68 for selectively moving the trimmers 62 trimming blades 64 transversally to the longitudinal axis Y) and therefore allow synchronization of the operations of the trimming assembly 60 with the operations of the components of the lumber piece grasping assembly 22, the longitudinal positioning assembly 50 and/or the supplemental supporting assembly 80, for grasping, maintaining, longitudinally moving, trimming and releasing the transferred lumber piece 16.

One skilled in the art will understand that, in an alternative embodiment, the lumber loading system 20 can be free of trimming assembly 60. For example and without being limitative, in an embodiment (not shown), the trimming assembly 60 can be provided along the second carrier assembly (not shown) onto which the lumber pieces 16 are loaded in the optimized longitudinal position, given the longitudinal movement thereof provided by the lumber loading system 20 loading the lumber pieces 16 onto the second carrier assembly.

In view of the above, the lumber loading system 20 is configured to allow the lumber pieces 16 to be positioned longitudinally during transfer thereof between components of a production line (e.g. between the first carrier assembly 12 and the second carrier assembly (not shown)). Therefore, in operation, the above described lumber loading system 20 provides a solution that minimizes the space along a production line for performing multiple tasks by performing the longitudinal positioning of the lumber pieces 16 (and in an embodiment the trimming of the lumber pieces 16) during the transfer performed by the lumber loading system 20.

Hence, in an embodiment, the longitudinal positioning (and in an embodiment the trimming) of the lumber pieces 16 does not interfere or negatively impact on the speed of operation of the lumber loading system 20, the driving shaft 21 of the lumber loading system 20 being allowed to rotate continuously to transfer the corresponding lumber piece 16 from the first carrier assembly 12 to the second carrier assembly.

The lumber loading system 20 having been described above, a sequence of operation of the lumber loading system (i.e. a method for simultaneous loading and longitudinal displacement of lumber pieces) will now be described in more details below.

In operation, the lumber pieces 16 are successively in a conveying direction defined by a lumber conveying axis X. The lumber pieces 16 are conveyed transversally on the first carrier assembly 12, towards the lumber loading system 20. During the conveying of the lumber pieces 16 (or previous manutention thereof) each lumber piece 16 is examined to generate optimization parameters thereof. Using the optimization parameters, an optimized longitudinal position of the lumber piece 16 is determined (or calculated). For example and without being limitative, the optimized longitudinal position can correspond to the longitudinal position best suited to perform an optimized trimming of at least one end of the lumber piece 16.

When each successive lumber piece 16 reaches the lumber loading system 20, in an embodiment, the lumber piece 16 is momentarily held against a stopper (not shown) until the lumber loading system 20 is ready to grasp the lumber piece 16. When the lumber loading system 20 is ready to grasp one of the successive lumber pieces 16, the stopper is retracted and the lumber piece 16 is moved towards a corresponding lumber piece grasping assembly 22. The lumber piece grasping assembly 22 grasps a section of the lumber piece 16 and maintains the section of the lumber piece 16 in a firm grip, with the lumber piece 16 extending longitudinally substantially parallel to the longitudinal axis Y. The rotation of the driving shaft 21 subsequently rotates the lumber piece grasping assembly 22 and the transferred lumber piece 16 held by the lumber piece grasping assembly 22, about the longitudinal axis Y.

In an embodiment, in order to perform the step of grasping the lumber piece 16, the piece grasping assembly 22 pivots at least one pivoting finger 39 in an engaged configuration to engage a surface of the lumber piece 16 and thereby sandwich a portion of the lumber piece 16 between a lumber supporting surface 35 of the lumber supporting member 34 of the piece grasping assembly 22 and the at least one pivoting finger 39 (i.e. press a portion of the lumber piece 16 against the lumber supporting surface 35 of the lumber supporting member 34 of the piece grasping assembly 22), to firmly maintain the section of the lumber piece 16 therebetween.

The method further includes the step of moving the lumber piece grasping assembly 22 longitudinally, to position the lumber piece 16 at the optimized longitudinal position thereof, while the lumber piece 16 is maintained by the lumber piece grasping assembly and the lumber piece grasping assembly is rotated about the longitudinal axis Y. In other words, during the transfer of the lumber piece 16 (i.e. during the rotation of the lumber piece grasping assembly 22 retaining the lumber piece 16) about the longitudinal axis Y, the corresponding lumber piece grasping assembly 22 is moved longitudinally (i.e. moved along the longitudinal axis Y of the driving shaft 21) to position the lumber piece 16 in the previously determined optimized longitudinal position thereof. Hence, the lumber piece 16 is moved longitudinally as it is held firmly by the lumber piece grasping assembly 22, as a result of the longitudinal movement of the lumber piece grasping assembly 22.

In an embodiment, the method includes the further step of trimming at least one end of the lumber piece 16, during the transfer of the lumber piece 16. (i.e. during the rotation of the lumber piece grasping assembly 22 retaining the lumber piece 16). Hence, during the transfer of the lumber piece 16, at least one end of the lumber piece 16 is trimmed by a trimming assembly 60. The step of trimming the end of the lumber piece 16 is performed subsequently to the lumber piece being positioned longitudinally, therefore allowing the lumber piece 16 to be trimmed according to the optimized parameters for longitudinal positioning thereof. Once again, in such an embodiment the end of the lumber piece 16 is trimmed as the lumber piece 16 is held firmly by the lumber piece grasping assembly 22 (i.e. as the lumber piece 16 is loaded by the lumber loading system 20 between the first carrier assembly 12 and the second carrier assembly (not shown)).

In an embodiment, the step of trimming at least one end of the lumber piece 16 includes the step of initially trimming a first end of the lumber piece 16 and subsequently trimming a second end of the lumber piece 16. The steps of trimming a first end of the lumber piece 16 and trimming a second end of the lumber piece 16 are performed at different angular position of the lumber piece grasping assembly 22 about the longitudinal axis Y.

In an embodiment, the steps of moving the lumber piece grasping assembly 22 longitudinally while the lumber piece 16 is maintained by the lumber piece grasping assembly and the lumber piece grasping assembly is rotated about the longitudinal axis Y includes performing a first longitudinal displacement of the lumber piece grasping assembly 22 prior to trimming a first end of the lumber piece 16 and performing a second longitudinal displacement of the lumber piece grasping assembly 22 following the trimming of the first end of the lumber piece 16 and prior to trimming the second end of the lumber piece 16.

In an embodiment, the method includes the further step of grasping at least one additional section of the lumber piece being transferred, using at least one supplemental supporting assembly 80 grasping a section of the lumber piece 16 and maintaining the lumber piece 16 in a firm grip. The rotation of the driving shaft 21 once again rotates the at least one supplemental supporting assembly 80 and the transferred lumber piece 16 held by the lumber piece grasping assembly 22, and the supplemental supporting assembly 80 about the longitudinal axis Y.

In an embodiment, where the step of trimming at least one end of the lumber piece 16 includes the step of initially trimming a first end of the lumber piece 16 and subsequently trimming a second end of the lumber piece 16, the at least one supplemental supporting assembly 80 can include a first subset 80*a* of supplemental supporting assemblies 80 and a second subset 80*b* of supplemental supporting assemblies 80. In such an embodiment, the method can include the steps of grasping a first additional section of the lumber piece 16 being transferred, using the first subset 80*a* of supplemental supporting assemblies 80, prior to trimming a first end of the lumber piece 16 (and following the first longitudinal displacement of the lumber piece grasping assembly 22); releasing the first additional section of the lumber piece being transferred prior to the second longitudinal displacement of the lumber piece grasping assembly 22; and grasping at least a second additional section of the lumber piece 16 being transferred, using the second subset 80*b* of supplemental supporting assemblies 80, prior to trimming a second end of the lumber piece 16 (and following the second longitudinal displacement of the lumber piece grasping assembly 22).

The method finally includes the step of releasing the lumber piece 16 onto the second carrier assembly (not shown). In other words, the lumber piece 16 is subsequently released by the lumber piece grasping assembly 22 (and the supplemental supporting assemblies 80 if such assemblies are used to maintain supplemental sections of the lumber piece 16) onto the second carrier assembly (not shown) and is conveyed transversally on the second carrier assembly (not shown) away from the lumber loading system 20.

In an embodiment, the above-described steps are coordinated by a control system (not shown) based on the optimization parameters for each of the lumber pieces. One skilled in the art will understand that, in an alternative embodiment, other mechanism or method could be used to coordinate the operation of the components to perform the above-described steps.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A lumber loading system for transferring lumber pieces conveyed in a conveying direction defined by a conveying axis, the lumber loading system comprising:

a driving shaft rotating about a longitudinal axis;

at least one lumber piece grasping assembly operatively connected to the driving shaft and rotating about the longitudinal axis along with the driving shaft, the at least one lumber piece grasping assembly being displaceable along the longitudinal axis and being operative to initially grasp a section of a corresponding one of the lumber pieces with the corresponding one of the lumber pieces extending longitudinally substantially parallel to the longitudinal axis, temporarily maintain the section of the lumber piece and subsequently release the lumber piece; and a longitudinal positioning system connected to the at least one lumber piece grasping assembly, the longitudinal positioning system moving each one of the at least one lumber piece grasping assembly independently along the longitudinal axis, during rotation thereof about the longitudinal axis.

2. The lumber loading system of claim 1, further comprising guiding shafts rotating along with the rotation of the driving shaft and extending along the longitudinal axis, the guiding shafts supporting each one of the at least one lumber piece grasping assembly slidably mounted thereon, with each one of the at least one lumber piece grasping assembly being movable longitudinally along corresponding ones of the guiding shafts.

3. The lumber loading system of claim 2, wherein the at least one lumber piece grasping assembly each include a carriage slidably engaged with the corresponding ones of the guiding shafts, the carriage comprising at least one lumber supporting member engaging a first surface of a corresponding lumber piece and at least one lumber grasping member selectively engageable to a second surface of the lumber piece, opposed to the first surface thereof.

4. The lumber loading system of claim 3, wherein the longitudinal positioning system comprises a linear actuator connected to the carriage of each one of the at least one lumber piece grasping assembly and selectively driving the corresponding carriage along the longitudinal axis.

5. The lumber loading system of claim 1, wherein the lumber loading system comprises a plurality of lumber piece grasping assemblies angularly spaced apart around the driving shaft.

6. The lumber loading system of claim 1, wherein the longitudinal axis is substantially perpendicular to the conveying axis.

7. The lumber loading system of claim 1, further comprising a trimming assembly configured and positioned to trim at least one end of the lumber pieces transferred by the lumber loading system, the trimming assembly comprising at least one trimmer having a trimming blade operatively connected to a motor driving the trimming blade in rotation.

8. The lumber loading system of claim 7, wherein the trimming assembly includes a first trimming assembly and a second trimming assembly, the first trimming assembly being positioned to trim a first end of the lumber pieces transferred by the lumber loading system at a first angular position about the longitudinal axis and the second trimming assembly being positioned to trim a second end of the lumber pieces transferred by the lumber loading system at a second angular position about the longitudinal axis, angularly distal from the first angular position.

9. The lumber loading system of claim 8, wherein the longitudinal positioning system is configured to position each one of the at least one lumber piece grasping assembly in a first longitudinal position along the longitudinal axis, prior to a corresponding one of the lumber pieces maintained thereby reaching the angular position of the first trimming assembly, and to position each one of the at least one lumber piece grasping assembly in a second longitudinal position along the longitudinal axis, prior to the corresponding one of the lumber pieces maintained thereby reaching the angular position of the second trimming assembly.

10. The lumber loading system of claim 1, further comprising at least one supplemental supporting assembly being operative to grasp, temporarily maintain and subsequently release a supplemental section of the lumber pieces along the longitudinal axis, during a least a portion of the transfer of the lumber pieces.

11. The lumber loading system of claim 10, wherein each one of the at least one supplemental supporting assembly comprises at least one support wheel mounted to the driving shaft and having a supplemental lumber engaging surface engageable to a first surface of the lumber pieces and at least one supplemental lumber grasping member selectively engageable to a second surface of the lumber pieces, opposed to the first surface thereof.

12. A method for simultaneous loading and longitudinal displacement of successive lumber pieces, for each one of the successive lumber pieces the method comprising the steps of:

conveying the lumber piece in a conveying direction defined by a conveying axis;

grasping the lumber piece using a lumber piece grasping assembly with the lumber piece extending longitudinally substantially parallel to a longitudinal axis substantially perpendicular to the conveying axis;

maintaining the lumber piece using the lumber piece grasping assembly during rotation of the lumber piece grasping assembly about the longitudinal axis and simultaneously displacing the lumber piece grasping assembly longitudinally along the longitudinal axis, to position the lumber piece at a predetermined longitudinal position thereof; and releasing the lumber piece from the lumber piece grasping assembly.

13. The method of claim 12, further comprising the step of determining an optimized longitudinal position of the lumber piece and wherein the predetermined longitudinal position is the optimized longitudinal position.

14. The method of claim 12, wherein the step of grasping the lumber piece using a lumber piece grasping assembly includes pivoting at least one pivoting finger in an engaged configuration to engage a surface of the lumber piece and press a portion of the lumber piece against a lumber supporting surface of the lumber supporting member of the lumber piece grasping assembly.

15. The method of claim 12, further comprising the step of trimming at least one end of the lumber piece, the step of trimming at least one end of the lumber piece being performed after the step of displacing the lumber piece grasping assembly longitudinally and before the step of releasing the lumber piece from the lumber piece grasping assembly.

16. The method of claim 15, further comprising the steps of initially trimming a first end of the lumber piece and subsequently trimming a second end of the lumber piece, the steps of trimming a first end of the lumber piece and trimming a second end of the lumber piece being performed at different angular positions of the lumber piece grasping assembly about the longitudinal axis.

17. The method of claim 16, wherein the steps of displacing the lumber piece grasping assembly longitudinally along the longitudinal axis comprises performing a first longitudinal displacement of the lumber piece grasping assembly prior to the step of trimming a first end of the lumber piece and performing a second longitudinal displacement of the lumber piece grasping assembly following the step of trimming the first end of the lumber piece and prior to the step of trimming the second end of the lumber piece.

18. The method of claim 12, further comprising the steps of:

grasping at least one additional section of the lumber piece being transferred, using at least one supplemental supporting assembly;

temporarily maintaining the at least one additional section of the lumber piece using the at least one supplemental supporting assembly; and releasing the lumber piece from the at least one supplemental supporting assembly.

19. The method of claim 17, further comprising the steps of:

grasping at least one additional section of the lumber piece being transferred, using at least one supplemental supporting assembly;

temporarily maintaining the at least one additional section of the lumber piece using the at least one supplemental supporting assembly; and releasing the lumber piece from the at least one supplemental supporting assembly.

20. The method of claim 19, comprising the steps of:

grasping a first additional section of the lumber piece being transferred, using a first subset of the at least one supplemental supporting assembly following the step of performing the first longitudinal displacement of the lumber piece grasping assembly and prior to the step of trimming the first end of the lumber piece;

releasing the lumber piece from the first subset of the at least one supplemental supporting assembly following the step of trimming the first end of the lumber piece and prior to the step of performing the second longitudinal displacement of the lumber piece grasping assembly;

grasping a second additional section of the lumber piece being transferred, using a second subset of the at least one supplemental supporting assembly following the step of performing the second longitudinal displacement of the lumber piece grasping assembly and prior to the step of trimming the second end of the lumber piece; and releasing the lumber piece from the at least one supplemental supporting assembly following the step of trimming the second end of the lumber piece.

* * * * *